US007021852B1

(12) United States Patent
Turner, III et al.

(10) Patent No.: US 7,021,852 B1
(45) Date of Patent: Apr. 4, 2006

(54) ARTICLE HOLDER

(75) Inventors: David C. Turner, III, Farmington, NM (US); Bernadette A. Turner, Farmington, NM (US); Ted J. Sprinkle, Farmington, NM (US); Sheryl L. Sprinkle, Farmington, NM (US)

(73) Assignee: Sherrette, LLC, Farmington, NM (US)

( * ) Notice: Subject to any disclaimer, the term of this patent is extended or adjusted under 35 U.S.C. 154(b) by 687 days.

(21) Appl. No.: 09/563,325

(22) Filed: May 3, 2000

(51) Int. Cl.
*B42F 13/02* (2006.01)

(52) U.S. Cl. ..... 402/19; 402/8; 402/20; 402/38; 402/13; 402/26; 402/31; 402/80 P; 402/36; 281/27.2; 281/27.3; 281/28; 24/3.6; 24/67.3; 24/67.9; 24/67.11; 24/67 P; 24/67 R; 70/336; 70/456 R; 70/456 B; 70/458; 70/459; 403/42; 403/166; 403/325

(58) Field of Classification Search ..... 402/19, 402/20, 38, 31, 26, 80 P, 13, 8, 36; 281/27.2, 281/27.3, 28; 24/3.6, 67.3, 67.9, 67.11, 67 P, 24/67 R; 70/336, 456 R, 456 B, 458, 459; 403/42, 166, 325
See application file for complete search history.

(56) References Cited

U.S. PATENT DOCUMENTS

| | | | | | |
|---|---|---|---|---|---|
| 123,360 | A | | 2/1872 | Porter et al. | |
| 184,355 | A | * | 11/1876 | Eastman | |
| 229,276 | A | * | 6/1880 | Riley et al | 63/8 |
| 240,857 | A | * | 5/1881 | Smith | 63/8 |
| 689,872 | A | * | 12/1901 | Griscom | 206/37.8 |
| 803,839 | A | * | 11/1905 | Merrill | 70/459 |
| 904,618 | A | * | 11/1908 | Kellner Jr | |
| 1,163,766 | A | * | 12/1915 | Morden | |
| 1,208,663 | A | * | 12/1916 | Rueckert | |
| 1,406,166 | A | * | 2/1922 | Bennett | |
| 1,407,863 | A | | 2/1922 | Hochenauer, Jr. | |
| 1,443,522 | A | * | 1/1923 | Buchan | |
| 1,557,550 | A | * | 10/1925 | Benson | |
| 1,704,137 | A | * | 3/1929 | Miller | 206/37.8 |
| 2,510,511 | A | * | 6/1950 | Mittendorf | |
| 2,871,691 | A | | 2/1959 | Bacon | |
| 2,978,897 | A | * | 4/1961 | Capitani | 70/456 R |
| 3,242,959 | A | | 3/1966 | Glass | |
| 3,896,526 | A | * | 7/1975 | Joiner | 24/67.1 |
| 4,277,434 | A | * | 7/1981 | Conway | 264/297 |
| 4,500,223 | A | * | 2/1985 | Downing et al. | 402/20 |
| 4,538,429 | A | * | 9/1985 | Bradford | 63/14 G |
| 4,682,792 | A | * | 7/1987 | Simmons | 281/45 |
| 4,811,973 | A | * | 3/1989 | Kumar-Misir | 402/79 |

(Continued)

FOREIGN PATENT DOCUMENTS

GB 2330113 * 4/1999

*Primary Examiner*—Boyer Ashley
*Assistant Examiner*—Mark Henderson
(74) *Attorney, Agent, or Firm*—Sughrue Mion, PLLC

(57) ABSTRACT

An open ring-like device for holding articles such as plastic cards and keys is formed so that its ends are opposed to one another and includes tips at the ends. The distance between the tips is less than the thickness of an article. Articles can be inserted into the device by pushing the edge of an article against the tips to spread the tips apart. The article is slid in between the tips to fit a tip through a hole in the article to hold the article on the device. The device allows for the insertion or extraction of articles without a separate step of opening or closing the device.

13 Claims, 5 Drawing Sheets

U.S. PATENT DOCUMENTS 4,867,594 A * 9/1989 Poulouin ..... 402/70
4,951,819 A * 8/1990 Gebert ..... 206/37.2
5,038,926 A 8/1991 can der Toorn
5,096,228 A 3/1992 Rinderknecht
5,138,855 A * 8/1992 Faris ..... 70/457
D337,200 S * 7/1993 Keller ..... D3/207
5,417,508 A * 5/1995 Friedman ..... 402/19
5,503,486 A * 4/1996 Zane ..... 402/72
5,533,236 A * 7/1996 Tseng ..... 24/67.5
5,692,847 A * 12/1997 Zane et al. ..... 402/38
5,829,176 A * 11/1998 Gruneisen, III ..... 40/376
5,899,501 A * 5/1999 Maxwell ..... 281/31
5,916,280 A * 6/1999 Lantz ..... 70/68
5,944,353 A * 8/1999 Sato ..... 281/29
5,992,887 A * 11/1999 Maruchi ..... 281/42
D425,127 S * 5/2000 Mackey ..... D19/65
D426,577 S * 6/2000 Mackey et al. ..... D19/89
6,095,711 A * 8/2000 Garfinkle ..... 402/19
6,113,298 A * 9/2000 Miro ..... 402/13
6,505,987 B1 * 1/2003 Turner et al. ..... 402/19
6,536,081 B1 * 3/2003 Allen et al. ..... 24/3.6

* cited by examiner

ARTICLE HOLDER

BACKGROUND OF THE INVENTION

1. Field of the Invention

The present invention relates to a device for keeping articles together, wherein the articles have a hole through which the device holds the articles and, more particularly, to an open ring-like device for holding articles and a novel method for inserting or extracting articles from the device.

2. Description of the Related Art

Cards such as credit cards or identification cards are used and often required for various purposes ranging from obtaining cash from an automatic teller machine or identifying oneself. These cards are commonly carried in the card pockets of wallets or purses. However, there are a limited number of pockets in a wallet or a purse, the visibility of the cards is restricted and a large number of cards can add an uncomfortable bulk to a wallet. Furthermore, extracting the cards can be a difficult task because the cards commonly have slippery surfaces and are stored in tightly fitting pockets.

U.S. Pat. No. 5,038,926 (van der Toorn) discloses a device which holds cards in a frame-like card holder with dimensions slightly larger than the card itself. Cards fit inside the holder which has a hole through which a ring keeps a number of holders together. However, this device requires the use of a holder for each of the cards and does not offer a novel approach to inserting or extracting cards from a ring.

U.S. Pat. No. 3,242,959 (Glass) discloses an invention which does not require a separate card holder for each of the cards. The invention uses cards modified with a slot and a hole located at the end of the slot. A spindle is slid into the slot and fitted into the hole. Unfortunately, this invention requires the use of specially manufactured cards or extensive card modification. These requirements are necessarily constrained by the information presented on the card surface in the form of a picture, a bar code or a magnetic strip.

U.S. Pat. No. 2,871,691 (Bacon) discloses a flexible one-piece key ring where a male end of the ring is inserted into a larger opposite distal female end of the ring whereby the location of barbs and gripping surfaces allow the ring to remain closed. However, the operation of this device requires a separate step of opening or closing the ring, in addition to inserting or extracting the keys.

U.S. Pat. No. 123,360 (Porter et al.) discloses a device designed to hold paper tickets. The device is a ring where one distal end is in the shape of a hook and an opposite distal end is in the shape of an eye. The ring is opened by dislodging the hook from the eye. The holes on the tickets are threaded through the hook to insert the tickets on the ring. Like the Bacon invention above, this invention requires a separate step of opening or closing the ring and inserting or extracting the tickets. Furthermore, the inner edge of the top half of the ring has a sharp edge so that tickets can be torn out, a feature not appropriate for keeping plastic cards.

U.S. Pat. No. 1,407,863 (Hochenauer) discloses a ring-shaped device where there is a ball fixed at one end of a ring. The ball partially fits into an opening at the opposite distal end of the ring. The ring is opened by laterally pushing the ball end out of alignment with the opposite distal end. Like the inventions mentioned above, this invention requires the user to manually open the ring and an additional step of inserting or extracting an article.

SUMMARY OF THE INVENTION

It is an object of the present invention to provide a device to hold articles which overcomes the above-mentioned difficulties associated with the previous devices.

The present invention relates to a device which facilitates the insertion and extraction of articles. An article can be inserted into the device by sliding the article in between tips disposed at the opening of the device and threading the device through a hole in the article. To extract an article, the article is simply pulled out through the tips.

In particular, the present invention relates to a device for holding together articles, comprising an open ring not limited to an annular shape. The ring is formed into a configuration such that distal ends are opposed to one another. Tips are disposed at each of the distal ends of the ring, the tips being operative to be displaced apart with respect to each other by an article. The tips will be sufficiently displaced to create an opening between the distal ends to allow the article to be inserted or extracted from the device. In one embodiment, the tips are preferably, but not necessarily, of spherical shape. Alternatively, in another embodiment, the tips further comprise an encasement disposed at each distal end, a biasing component inside each encasement, and an end tip disposed at an end of each encasement.

In addition, the invention further relates to a device which includes a jacket attached to the ring to cover articles held on the ring.

Lastly, it is an object of the present invention to provide a method of holding articles together by forming an open ring not limited to an annular shape. The ring is formed into a configuration such that distal ends are opposed to one another and tips are disposed at the distal ends. Next, the method comprises pushing an edge of an article in between the tips to displace the tips apart. Finally, the method comprises sliding the article in between the tips, and threading a distal end through a hole in the article. In one embodiment, the tips are preferably, but not necessarily, of spherical shape. Alternatively, in another embodiment, the method further comprises pushing an end tip into an encasement disposed at the distal end, against a biasing component inside the encasement.

In addition, the method further comprises attaching a jacket on the ring to cover articles held on the ring.

BRIEF DESCRIPTION OF THE DRAWINGS

Other features and advantages of the present invention will be apparent from the following description taken in connection with the accompanying drawings, wherein.

DETAILED DESCRIPTION OF THE PREFERRED EMBODIMENTS

Figure 1:
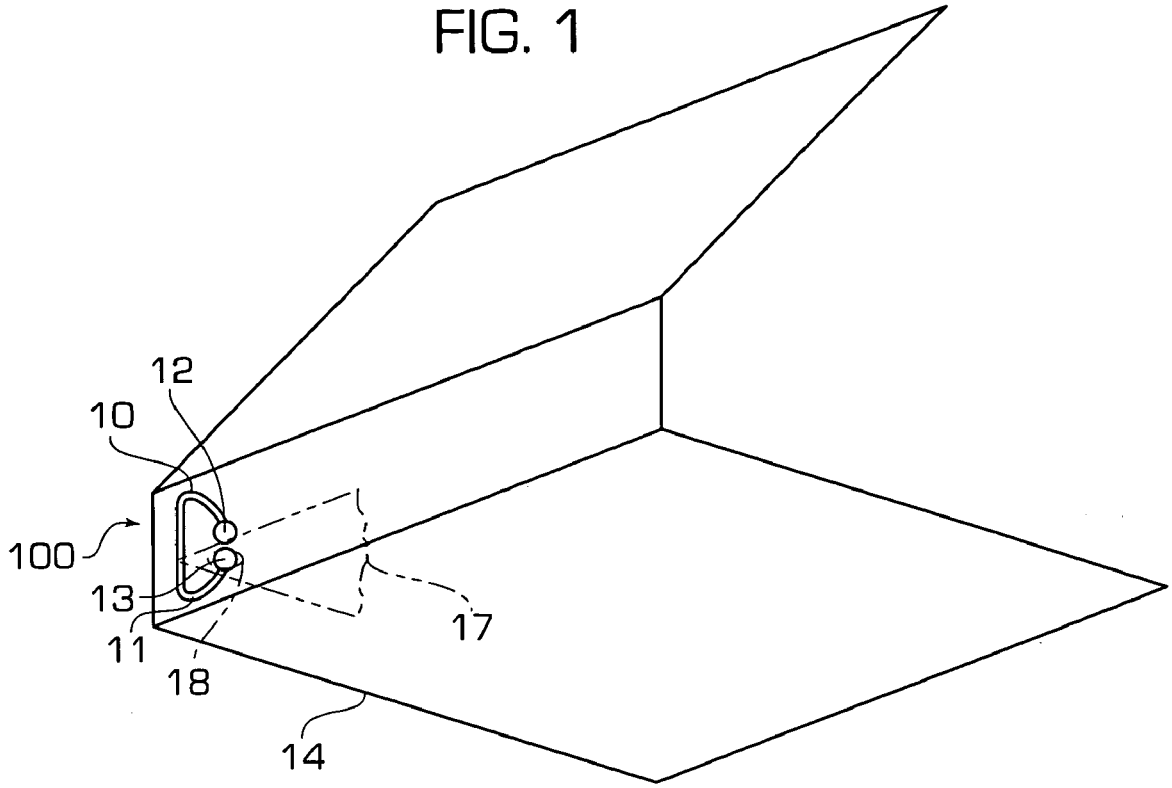
FIG. 1 is a perspective view of an article holder of a first embodiment attached to a jacket according to the present invention.

The present invention will now be described with reference to the drawings. Shown in FIG. 1 is an article holder in the form of a first embodiment of the present invention. The device comprises an open ring 100 not limited to an annular shape, with opposing distal ends 10, 11. A tip 12 is disposed at the distal end 10 and a tip 13 is disposed at the opposing distal end 11. In their rest positions, the opposing tips 12, 13 are separated by a distance less than the thickness of an article 17. For example, the distance between the tips 12, 13 is less than approximately 1 mm for an article holder carrying bank debit cards, credit cards, club membership cards, or the like. In FIG. 1, the tips 12, 13 are preferably, but not necessarily, spherical or ball members.

The operation of this embodiment will be described in the following.

Figure 4:
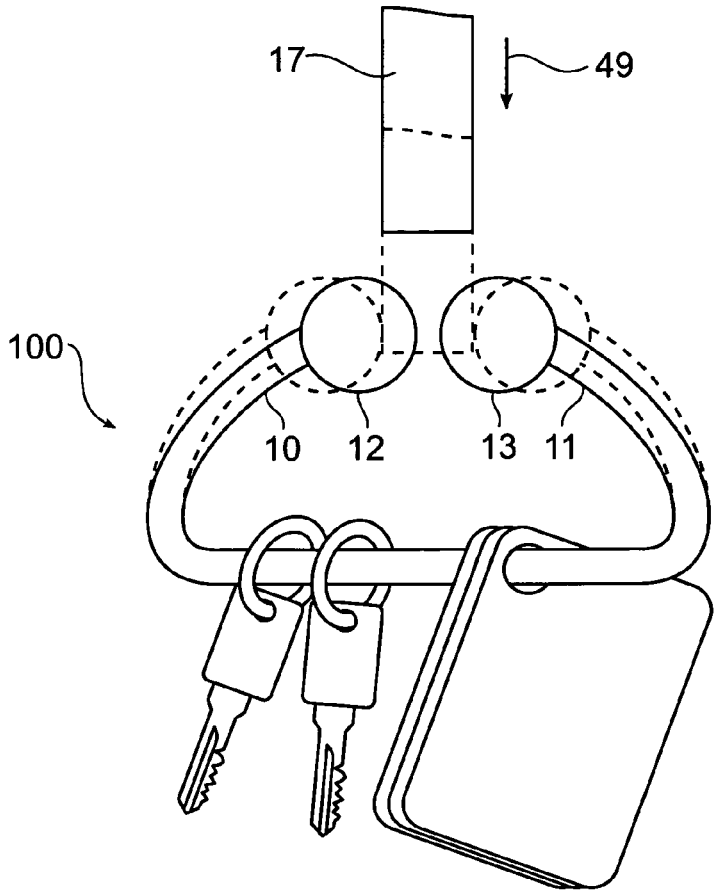
FIG. 4 is a lateral view of an article holder of the first embodiment showing an action of inserting an article according to the present invention.

FIG. 4 shows the action of inserting an article 17 into the ring 100 of the first embodiment. To insert the article 17, an edge of the article is pushed in between the tips 12, 13. The pushing force 49 displaces the tips 12, 13 from their rest positions to allow the article 17 to slide in between the tips 12, 13. The tips 12, 13 are aligned with a hole 18 (in FIG. 1) in the article 17 to return the tips 12, 13 to their rest positions. Tip 12 is threaded through the hole 18 (in FIG. 1) to complete the insertion of the article 17 on the ring 100. Alternatively, tip 13 is threaded through the hole 18 (in FIG. 1) to complete the insertion of the article 17 on the ring 100.

To extract an article, hole 18 (in FIG. 1) in the article 17 is aligned in between the tips 12, 13 and pulled out. The pulling force will displace the tips 12, 13 to allow the article 17 to slide off the ring 100. After the article 17 is extracted, the tips 12, 13 are returned to their rest positions.

Figure 2:
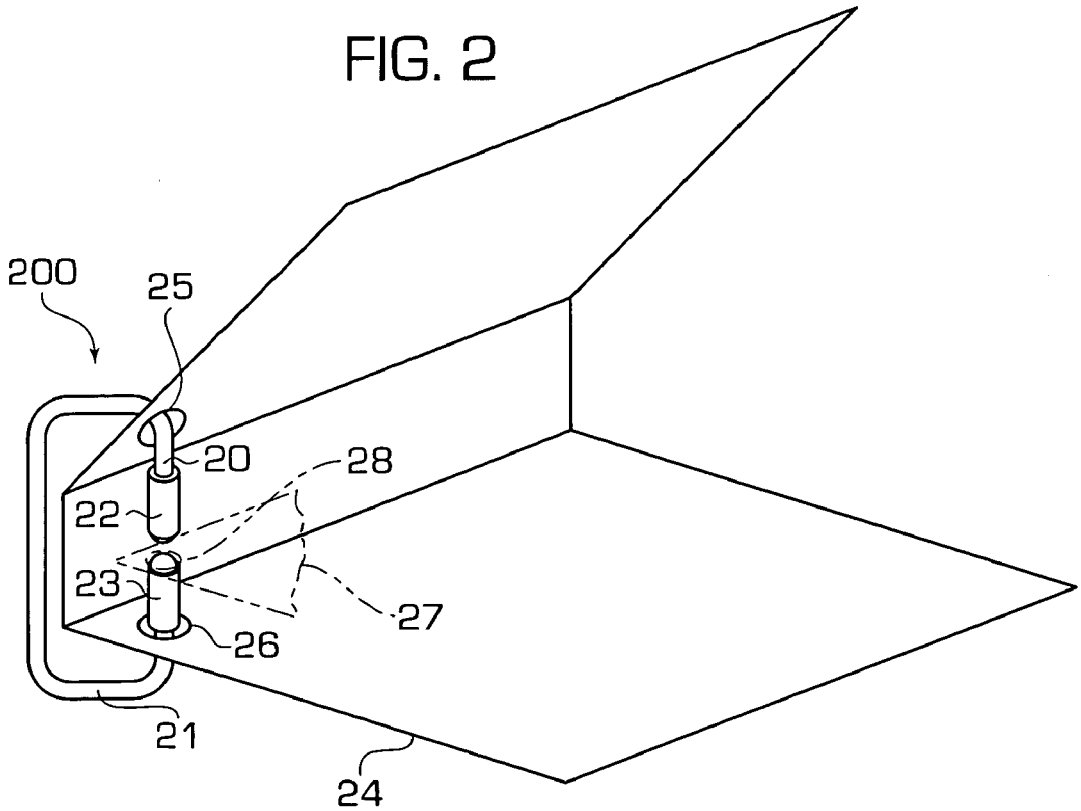
FIG. 2 is a perspective view of an article holder of a second embodiment fitted to a jacket according to the present invention.
Figure 3:
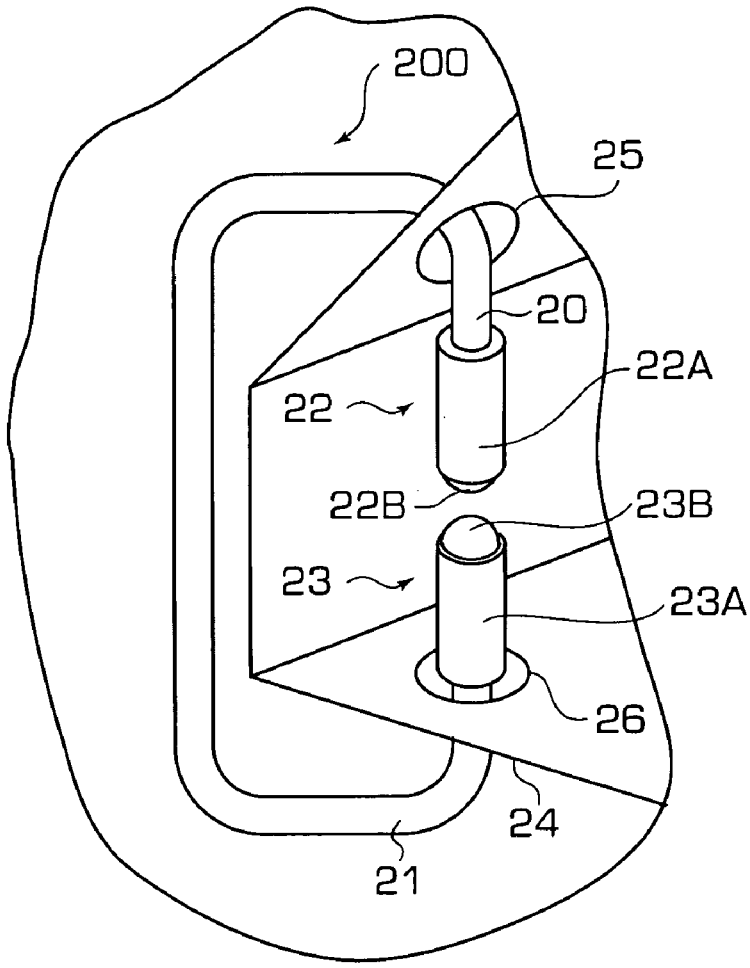
FIG. 3 is a fragmentary close-up view of an article holder of the second embodiment according to the present invention.

A second embodiment of the device is shown in FIG. 2. The device comprises an open ring 200 not limited to an annular shape, formed into a configuration such that distal ends 20, 21 are opposed to one another. A tip 22 is disposed at a distal end 20 and a tip 23 is disposed at the opposing distal end 21. FIG. 3 is a fragmentary close-up view of the second embodiment in FIG. 2. Representative of tip 22, tip 23 will be described in detail.

Tip 23 has an encasement 23A disposed at the distal end 21. An end tip 23B is disposed at the end of the encasement 23A opposite the end of the encasement 23A disposed at the distal end 21. The end of the encasement 23A opposite from the end disposed at the distal end 21, is tapered and of dimensions less than that of the end tip 23B to prevent the end tip 23B from falling out of the encasement 23A. The end tips 22B, 23B are preferably, but not necessarily, spherical or ball members. In their rest positions, the opposing end tips 22B, 23B are separated by a distance less than the thickness of an article 27. Biasing components 22C, 23C (shown in FIG. 5) are disposed within the encasements 22A, 23A.

The biasing components 22C, 23C are preferably, but not necessarily, coil compression springs. Alternatively, the biasing components 22C, 23C may be elastomer members. Further, the biasing components 22C, 23C may be, alternatively, metal members formed into a configuration with a resilient property. Still further, the biasing components may be, alternatively, metal members formed in an accordion shape with a resilient property.

The operation of the second embodiment will be described in the following.

Figure 5:
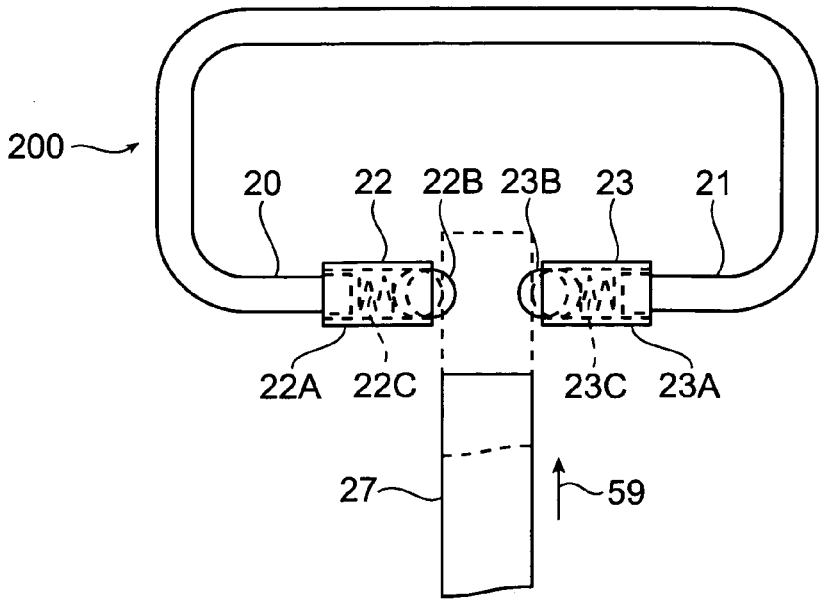
FIG. 5 is a lateral view of an article holder of the second embodiment showing an action of inserting an article according to the present invention.

The insertion of an article 27 is shown in FIG. 5. The edge of the article 27 is pushed in between the end tips 22B, 23B, displacing the end tips 22B, 23B into their respective encasements 22A, 23A against the bias of the biasing components 22C, 23C. The displacement of the end tips 22B, 23B allows the article 27 to slide in between the end tips 22B, 23B. Distal end 22 is threaded through a hole 28 (in FIG. 2) in the article 27. Alternatively, distal end 23 is threaded through the hole 28 (in FIG. 2) in the article 27. By the action of the biasing components 22C, 23C, the end tips 22B, 23B return to their rest positions.

To extract an article 27, the hole 23 (in FIG. 2) in the article 27 is lined up with the end tips 22B, 23B and pulled out. The pulling force will displace the end tips 22B, 23B to allow the article 24 to slide off the ring 200. After the article 27 is extracted, the end tips 22B, 23B return to their rest positions by the action of the biasing components 22C, 23C.

Figure 6:
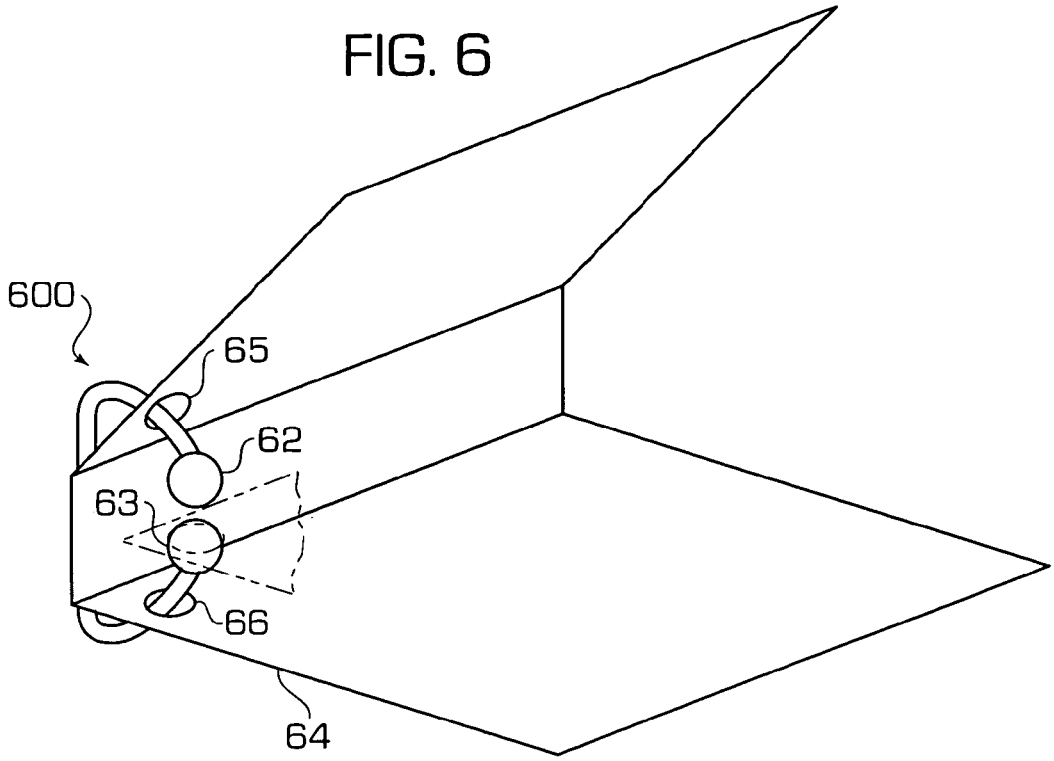
FIG. 6 is a perspective view of an article holder of the first embodiment fitted on the outside of a jacket with tips inside the jacket according to the present invention.
Figure 8:
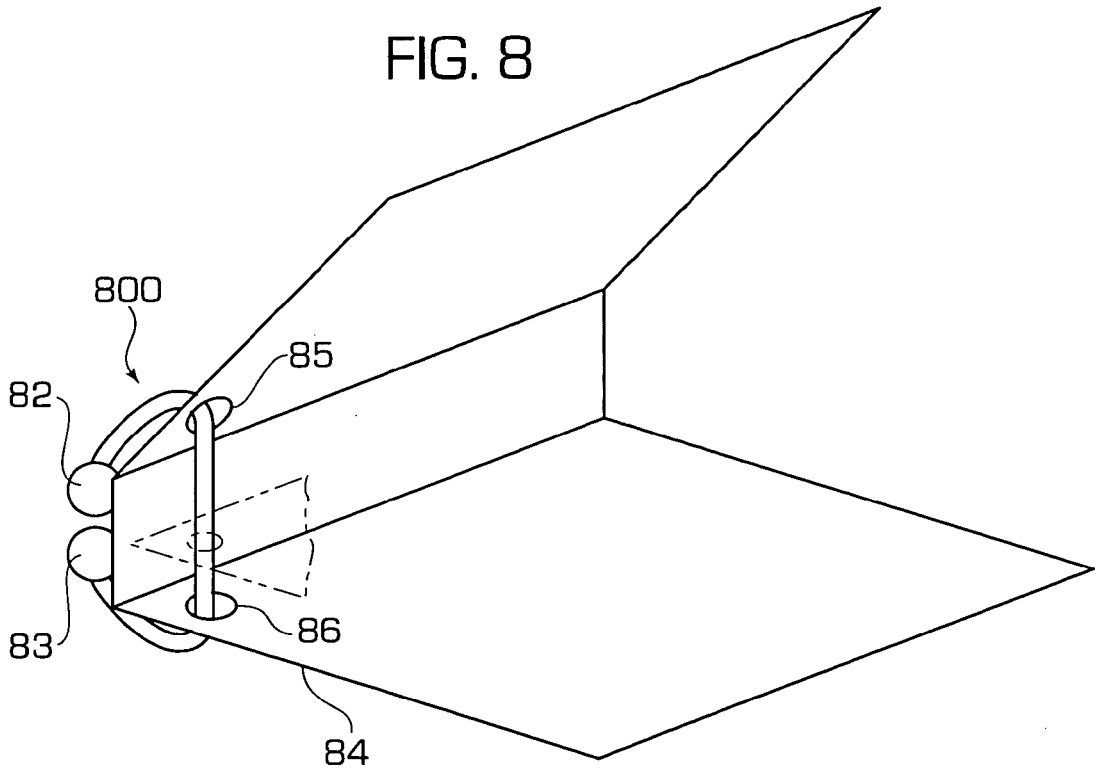
FIG. 8 is a perspective view of an article holder of the first embodiment fitted on the outside of a jacket, with tips outside the jacket according to the present invention.

In addition to the embodiments described above, a jacket, formed from leather, cloth, canvas, plastic, metal, or the like, may be provided which covers the articles held on the ring. FIG. 1 shows the ring 100 of the first embodiment attached inside a jacket 14. Additionally, FIG. 6 shows a ring 600 fitted on the outside of a jacket 64 through through-holes 65, 66 and oriented so that the tips 62 and 63 are inside the jacket 64. Furthermore, FIG. 8 shows a ring 800 fitted on the outside of a jacket 84 through through-holes 85, 86 and oriented so that the tips 82, 83 are outside the jacket 84.

Figure 7:
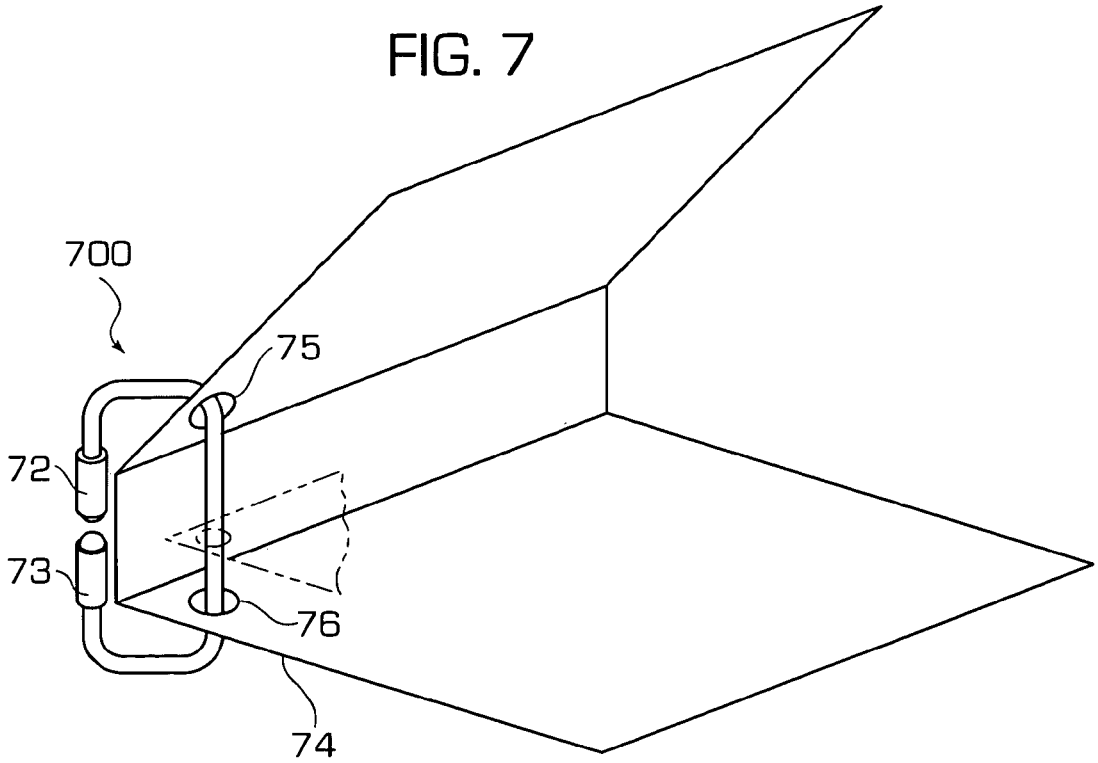
FIG. 7 is a perspective view of the article holder of the second embodiment fitted on the outside of a jacket, with tips outside the jacket according to the present invention.

FIG. 2 shows a ring 200 of the second embodiment fitted on the outside of a jacket 24 through through-holes 25, 26 with the tips 22, 23 inside the jacket 24. Alternatively, the ring 200 may be attached inside the jacket 24 with the tips 22, 23 inside the jacket 24, similar to the first embodiment of FIG. 1. Moreover, FIG. 7 shows a ring 700 fitted on the outside of a jacket 74 through through-holes 75, 76 with the tips 72, 73 outside the jacket 74.

Alternatively, the ring may be sewn on the jacket. Further, the ring may be, alternatively, laced to the jacket. Still further, the ring may be, alternatively, threadedly disposed within the jacket material.

A method of holding articles together is explained below in connection with FIG. 4. The open ring 100 not limited to an annular shape, is formed into a configuration such that the distal ends 10, 11 are opposed to one another and tips 12, 13 are disposed at the distal ends 10, 11. In their rest positions, the tips 12, 13 are separated by a distance less than the thickness of an article 17. An edge of the article 17 is pushed by pushing force 49 in between the tips 12, 13 to displace the tips 12, 13 apart, and is slid in between the tips 12, 13. Tip 12 is threaded through a hole 18 (in FIG. 1) in the article 17 and the tips 12, 13 return to their rest positions to complete the insertion of the article 17 on the ring 100. Alternatively, tip 13 is threaded through the hole 18 (in FIG. 1) in the article 17 and the tips 12, 13 return to their rest positions to complete the insertion of the article 17 on the ring 100.

To extract an article, hole 18 (in FIG. 1) in article 17 is aligned in between the tips 12, 13. Article 17 is pulled out, displacing the tips 12, 13 apart. When the article 17 is completely removed from the ring 100, the end tips 12,13 return to their rest positions.

An alternative method of holding articles together is explained below in FIG. 5. The ring 200 not limited to an annular shape is formed into a configuration such that the distal ends 20, 21 are opposed to one another and tips 22, 23 are disposed at the distal ends 20, 21. Encasements 22A, 23A are disposed at the distal ends 20, 21. End tips 22B, 23B disposed at the end of encasements 22A, 23A, are separated by a distance less than the thickness of an article 27, in their rest positions.

An edge of the article 27 is pushed by pushing force 59 in between the tips 22, 23, displacing the end tips 22B, 23B into the encasements 22A, 23A, against the action of biasing components 22C, 23C disposed inside the encasements 22A, 23A. When a hole 28 (in FIG. 2) in the article 27 is aligned with the end tips 22B, 23B, the end tips 22B, 23B are returned to their rest positions by the action of the biasing components 22C, 23C. Tip 22 is threaded through the hole 28 (in FIG. 2) in the article 27 to complete the insertion of the article 27. Alternatively, tip 23 is threaded through the hole 28 (in FIG. 2) in the article 27 to complete the insertion of the article 27.

To extract an article, hole 28 (in FIG. 2) in article 27 is aligned in between the end tips 22B, 23B. Article 27 is pulled out, displacing the end tips 22B, 23B into the encasements 22A, 23A. When the article 27 is completely removed from the ring 200, the biasing components 22C, 23C push the end tips 22B, 23B back to their rest positions.

In using the invention, pushing or pulling an article such as a plastic card or a key will simultaneously create an opening sufficient to insert or extract an article on the ring. In contrast to the prior art, a separate act of twisting laterally as in U.S. Pat. No. 1,407,863 (Hochenauer), twisting axially as in U.S. Pat. No. 2,871,691 (Bacon), or twisting longitudinally as in U.S. Pat. No. 123,360 (Porter et al.) is not required to open the device. In all the referenced prior art, with the exception of U.S. Pat. No. 5,038,926 (van der Toorn) which does not disclose a method of insertion or extraction, insertion or extraction requires the additional steps of opening and closing the device. In the present invention, insertion or extraction does not require a separate step of opening or closing the device.

It is contemplated that numerous modifications may be made to the present invention without departing from the spirit and scope of the invention as defined in the following claims.

What is claimed is:

1. A device for holding together at least one of keys and cards, comprising:

a) an open ring in one of an annular and a non-annular shape, formed into a configuration such that distal ends are opposed to one another;

b) a tip disposed at each of the distal ends of the ring, said tips being operative to be displaced apart with respect to each other by the at least one of keys and cards to create a sufficiently wide opening between the distal ends and to allow the at least one of keys and cards to be inserted or extracted from the device, wherein the tips are of spherical shape and immovably disposed at the distal ends; and c) a jacket attached to the ring, said jacket being operative to cover the at least one of keys and cards.

2. The device as claimed in claim 1, wherein the ring is attached inside the jacket.

3. The device as claimed in claim 1, wherein the ring is fitted on the outside of the jacket through through-holes in the jacket.

4. A device for holding together at least one of keys and cards, comprising:

a) an open ring in one of an annular and a non-annular shape, formed into a configuration such that distal ends are opposed to one another;

b) a tip disposed at each of the distal ends of the ring, said tips being operative to be displaced apart with respect to each other by the at least one of keys and cards to create a sufficiently wide opening between the distal ends and to allow the at least one of keys and cards to be inserted or extracted from the device, wherein each of the tips further comprises:

an encasement disposed at a corresponding one of the distal ends, a biasing component inside the encasement, and an end tip disposed at an end of the encasement opposite the end disposed on the corresponding distal end; and c) a jacket, the ring being attached to a binding portion of the jacket, said jacket being operative to cover the at least one of the keys and cards and to cover said ring in its entirety.

5. In combination with at least one card, a card holder comprising:

a) an open ring in one of an annular and a non-annular shape, formed into a configuration such that distal ends are opposed to one another and form an opening between the distal ends;

b) a spherical tip disposed at each of the distal ends of the ring, wherein the distance between the tips is less than the thickness of said at least one card, said tips being operative to be displaced away from each other by said at least one card to create a sufficiently wide opening between the distal ends and to allow said at least one card to be inserted or extracted from the device, said tips comprising:

an encasement disposed at a corresponding one of the distal ends;

a biasing component inside the encasement; and an end tip disposed at an end of the encasement opposite the end disposed on the corresponding distal end; and c) a jacket, the ring being attached to a binding portion of the jacket, said jacket being operative to cover said at least one card and to cover said ring in its entirety.

6. The device as claimed in claim 5, wherein the ring is attached inside the jacket.

7. The device as claimed in claim 5, wherein the ring is fitted on the outside of the jacket through through-holes in the jacket.

8. A method of holding at least one of keys and cards together, said method comprising:

a) forming an open ring in one of an annular and a non-annular shape, into a configuration such that distal ends are opposed to one another and tips are respectively immovably disposed at the distal ends;

b) pushing an edge of at least one of a key and a card in between the tips to push the tips apart and sliding the at least one of a key and a card in between the tips;

c) threading a distal end through a hole in the at least one of a key and a card; and d) covering the at least one of keys and cards with a jacket.

9. The method of claim 8, wherein the tips are spherically shaped.

10. The method of claim 8, wherein the method holds together cards, and wherein the step of pushing an edge of a card in between the tips to push the tips apart and sliding the card in between the tips further comprises; pushing an end tip into an encasement disposed at each distal end, against a biasing component inside each encasement.

11. The method of claim 8, wherein the tips are rigidly fixed at the distal ends.

12. The method of claim 11, further comprising attaching the ring on the inside of the jacket.

13. The method of claim 11, further comprising fitting the ring through through-holes in the jacket.

* * * * *